US009966659B2

(12) United States Patent
Chakam et al.

(10) Patent No.: US 9,966,659 B2
(45) Date of Patent: May 8, 2018

(54) ANTENNA MODULE HAVING A TRANSMITTING AND RECEIVING ANTENNA ELEMENT

(71) Applicants: Continental Automotive GmbH, Hannover (DE); Kathrein-Werke KG, Rosenheim (DE)

(72) Inventors: Guy-Aymar Chakam, Regensburg (DE); Gerald Schillmeier, München (DE); Frank Mierke, München (DE); Gerhard Vogt, Rosenheim (DE)

(73) Assignees: Continental Automotive GmbH, Hanover (DE); Kathrein-Werke KG, Rosenheim (DE)

( * ) Notice: Subject to any disclaimer, the term of this patent is extended or adjusted under 35 U.S.C. 154(b) by 142 days.

(21) Appl. No.: 14/400,869

(22) PCT Filed: May 15, 2013

(86) PCT No.: PCT/EP2013/059985

§ 371 (c)(1),
(2) Date: Nov. 13, 2014

(87) PCT Pub. No.: WO2013/171240

PCT Pub. Date: Nov. 21, 2013

(65) Prior Publication Data

US 2015/0123854 A1 May 7, 2015

(30) Foreign Application Priority Data

May 16, 2012 (DE) ..... 10 2012 208 303

(51) Int. Cl.
*H01Q 1/32* (2006.01)
*H01Q 1/12* (2006.01)
*H01Q 1/24* (2006.01)

(52) U.S. Cl.
CPC ..... *H01Q 1/3275* (2013.01); *H01Q 1/1214* (2013.01); *H01Q 1/241* (2013.01)

(58) Field of Classification Search
CPC ..... H01Q 1/3275; H01Q 1/1214; H01Q 1/32; H01Q 1/325; H01Q 1/3258; H01Q 1/3266; H01Q 1/3283; H01Q 1/3291
See application file for complete search history.

(56) References Cited

U.S. PATENT DOCUMENTS 6,396,447 B1 * 5/2002 Jonasson ..... H01Q 1/3275 343/711
7,193,572 B2 3/2007 Magg
(Continued)

FOREIGN PATENT DOCUMENTS

DE 29500961 6/1995
DE 4403643 8/1995
(Continued)

OTHER PUBLICATIONS

Japanese Office Action dated Feb. 8, 2016 in Japanese Application No. 2015-512044, with English translation.
(Continued)

*Primary Examiner* — Daniel J Munoz
(74) *Attorney, Agent, or Firm* — RatnerPrestia

(57) ABSTRACT

A one-piece antenna module, has at least one outside receiving and/or transmitting antenna element under an outer cover. The one-piece antenna module has an antenna box, which has no or few inside internal antennas and which surrounds the electronic circuits that interact with the antenna elements. The outer cover is detachably fastened to the antenna box and can be attached so as to protrude from an opening in the vehicle roof. The antenna box is closed on all sides and can be attached below the vehicle roof by a metal top side. The metal closed top side has feed-throughs for the outside antenna elements. The outside antenna elements in the outer cover are electrically coupled to the circuits inside the antenna box closed on all sides by the feed-throughs. Thus, a compact installation part is obtained, which provides complete shielding between an antenna part and a transceiver part.

19 Claims, 4 Drawing Sheets

(56) References Cited

U.S. PATENT DOCUMENTS

| | | | | |
|---|---|---|---|---|
| 7,224,318 | B2 | 5/2007 | Mikami | |
| 8,462,059 | B2 | 6/2013 | Schnuerer | |
| 8,614,645 | B2 | 12/2013 | Chakam | |
| 2003/0189521 | A1* | 10/2003 | Yamamoto | H01Q 3/24 343/702 |
| 2005/0012670 | A1* | 1/2005 | Mathiae | H01Q 1/3275 343/713 |
| 2007/0103374 | A1* | 5/2007 | Lindackers | H01Q 1/3275 343/713 |
| 2007/0279304 | A1* | 12/2007 | Chakam | H01Q 1/088 343/713 |
| 2010/0231467 | A1* | 9/2010 | Schnuerer | H01Q 1/1214 343/713 |
| 2011/0279337 | A1* | 11/2011 | Corwin | H01Q 1/088 343/713 |
| 2012/0274519 | A1* | 11/2012 | Chakam | H01Q 1/3275 343/702 |
| 2014/0028507 | A1 | 1/2014 | Mierke | |

FOREIGN PATENT DOCUMENTS

| | | |
|---|---|---|
| DE | 20111229 | 10/2001 |
| DE | 10034387 | 1/2002 |
| DE | 10219222 | 11/2003 |
| DE | 10221877 | 12/2003 |
| DE | 102004005656 | 4/2005 |
| DE | 102006025176 | 12/2007 |
| DE | 102009051605 | 5/2011 |
| DE | 102011016294 | 10/2012 |
| EP | 1286414 | 2/2003 |
| EP | 1863119 | 12/2007 |
| EP | 1903632 | 3/2008 |
| EP | 2228865 | 9/2010 |
| GB | 2298998 | 9/1996 |
| JP | 64005504 | 1/1989 |
| JP | 2004040166 | 2/2004 |

OTHER PUBLICATIONS

International Search Report for International Application No. PCT/EP2013/059985 dated Jul. 12, 2013.

Written Opinion ofthe International Searching Authority for International Application No. PCT/EP2013/059985 dated Jul. 12, 2013, including English langauge translation.

German Search Report for German Application No. 10 2012 208 303.0 dated Nov. 9, 2012, including partial English translation.

* cited by examiner

ANTENNA MODULE HAVING A TRANSMITTING AND RECEIVING ANTENNA ELEMENT

CROSS REFERENCE TO RELATED APPLICATIONS

This application is the U.S. National Phase Application of PCT/EP2013/059985, filed May 15, 2013, which claims priority to German Patent Application No. 10 2012 208 303.0, filed May 16, 2012, the contents of such applications being incorporated by reference herein.

FIELD OF THE INVENTION

The invention relates to a one-piece antenna module having at least one transmitting antenna element and at least one receiving antenna element. The antenna module has an outer cover for external antenna elements. An antenna box comprises electronic circuits which interact with the antenna elements. The outer cover is detachably secured to the antenna box. The outer cover can be attached through an opening in a vehicle roof in such a way that it projects out of the vehicle roof.

BACKGROUND OF THE INVENTION

Document EP 1 903 632 B1, which is incorporated by reference, discloses an antenna module, in particular as a central transmitting and/or receiving module, for a vehicle, having a plurality of antennas and a plurality of transmitting and/or receiving devices. For this purpose, the transmitting and/or receiving devices are integrated in the form of a central transceiver box into the antenna module. Furthermore, the antenna module has an upper and a lower part, each with a plurality of antennas which are separated by an area of the body work of a vehicle. In this context, the circuit board for the upper area is offset from the circuit board for the lower area with the aid of connectors or spacer elements.

In one preferred embodiment of the known antenna module, the transceiver box is screwed onto a lower side of the vehicle body part, wherein the vehicle body part has a large opening toward the outside, in which opening the upper part of the antenna module with the transmitting and receiving antennas for certain services is arranged. This embodiment of an antenna module has the following disadvantages:

1. two circuit boards are used, which gives rise to the need for high-frequency-compatible connectors for two circuit boards,
2. radiation of the external antennas into the passenger compartment is possible,
3. large circuit board faces (top and bottom) are necessary since space is needed for the HF connectors including blocking faces,
4. very high costs are incurred since two circuit boards, connectors and necessary mounting steps are needed, and
5. there is no possible way of compensating for a curvature of the roof.

SUMMARY OF THE INVENTION

An aspect of the invention aims to overcome the disadvantages of the prior art and to provide an antenna module for a vehicle which can be mounted as an installation part in the roof region of a vehicle in a cost-effective and compact fashion and provides complete shielding between an upper outer antenna part and a transceiver part which is secured on an inner side of a vehicle roof.

In one embodiment of the invention, an antenna module which is one piece has at least one external receiving and/or transmitting antenna element under an outer cover. In addition, the one-piece antenna module comprises an antenna box, which has no or few internal antennas on the inner side and which encloses electronic circuits which interact with the antenna elements. The outer cover is detachably secured to the antenna box. The outer cover can be attached through an opening in a vehicle roof in such a way that it projects out of the vehicle roof. The antenna box is closed on all sides and can be attached underneath the vehicle roof to a metallic upper side. The metallic closed upper side of the antenna box has feedthroughs to the external antenna elements. The external antenna elements in the outer cover are electrically coupled to the circuits within the antenna box, which is closed on all sides, via the feedthroughs.

This antenna module has the advantage that the antenna module is available in one piece for installation in a vehicle. Moreover, the one-piece antenna module has the advantage that the large opening in the antenna roof, which opening is adapted to the outer cover, in order to permit the antenna elements to project outward through the opening in the vehicle roof with simple means and in a compact fashion, forms, through the closed and electrically conductive metallic upper side of the antenna box in conjunction with the vehicle roof, a ground shielding which makes available a clear means of providing isolation between an external region of the antenna module with the antenna radiators and an inner closed antenna box.

As a result of the shielding composed of an outer roof and a metallic upper side of the antenna box which is closed on all sides, electromagnetic isolation of the antenna elements and of the antennas and circuits arranged in the closed antenna box is ensured. As a result, an interference-free ground connection of the antenna module to the vehicle for the electronics and for the antennas is achieved. In order to attach or adapt the antenna box to the roof in a way which is compatible with the roof, coupling elements are additionally used on the metallic upper side of the antenna box. The said coupling elements are composed of compressible metallic foamed material in order to compensate the curvature of the roof.

Despite the electromagnetic decoupling between the external antenna elements and the antenna box which is closed on all sides with internal antennas and various circuits, the antenna module constitutes a one-piece antenna module which is easy to mount, even if one region of the antenna module projects out of the vehicle body and the vehicle roof and another region is mounted underneath the vehicle roof while forming contact therewith. This is achieved by means of the antenna box which is closed on all sides and has a metallically conductive upper side on which an elevated portion with the lower cross-sectional shape of the outer cover is located, in which portion the external antennas for the services with vehicle-external connections such as, for example, satellite services, telephone services etc. are arranged.

The antenna box can be completely or partially made of plastic or metal. This depends on the services which are integrated into the antenna module. While, for example, the upper side of the box is made of metal, the four lateral edges of the box and the lower side of the box can be made of plastic. This is the case, for example, if services such as, for example, a passive start and entry system (PASE system) with a vehicle-internal connection are required.

In the event of the antenna box being completely made of metal in order to ensure reliable shielding of an antenna circuit board with transceivers, tuners or other electronic circuits, it is also possible that antennas for vehicle-internal connections are integrated or mounted on the four lateral edges of the box as well as on the lower side of the box. The antenna elements which project out of the vehicle roof are isolated electromagnetically from the antenna box under the outer cover by means of the metallic upper side which is provided on the antenna box which is closed on all sides.

In the event of the antenna box being made completely from plastic, there are either no external antenna elements or the necessary electromagnetic isolation is implemented both on the main circuit board and on the upper side of the antenna box by attaching compressible coupling elements made of metallic foamed material or plastic on the main circuit board and on the upper side of the antenna box along the roof cutout.

The external antenna elements for vehicle-external services which are arranged within the outer cover are connected to an antenna main circuit board within the antenna box which is closed on all sides, in that the base points or the feed-in points of the antenna elements for vehicle-external services are looped through the metallic upper side of the antenna box as far as the antenna circuit board and soldered onto the antenna circuit board. In this context, several antennas, such as the patch antenna for satellite communication, can rest on the metallic upper side of the antenna box which is closed on all sides.

The antenna feed-in points are guided through the metallic upper side of the antenna box by means of vias and in the process form a co-axial line, also within the box. Such feedthroughs may be obtained, for example, by means of minimal cutouts in the upper side made of metal, which are filled with plastic.

At the same time, the metallic upper side of the antenna box which is closed on all sides forms a load-bearing element which can absorb all the mechanical forces which occur. For this purpose, the upper side of the antenna box which is closed on all sides can be a pressure die casting or be composed from a punched piece of sheet metal. In addition, shielding chambers can be integrated which are additionally used for protecting the electromagnetic circuit and are soldered onto the antenna circuit board within the closed antenna box using pins. Such shielding chambers can therefore shield a partial region of the respective circuit on the antenna circuit board, in particular if the lower region, which is directed toward the interior of the vehicle, is fabricated from plastic. As a result, the antenna box can be compared with the chassis of contemporary antenna solutions which are mounted on the roof, but this chassis is, in one embodiment of the invention, mounted under the roof, and the antenna circuit board is mounted on the vehicle-internal side of the chassis.

For the antenna module just a single antenna circuit board is preferably provided, on which antenna circuit board the necessary receivers, transceivers and adaptation circuits are located and the antenna feed-in points are soldered. The active antenna elements which project through the opening in the vehicle roof can be embodied as PCB (printed circuit board) antennas, for example composed of an FR4 circuit board, and are arranged in a vertically upright fashion relative to the antenna circuit board in the antenna box which is closed on all sides.

An arrangement of a plurality of antenna elements depends on the effect to be achieved in terms of gain, shape of the radiation diagrams, isolation and in correlation with the VSWR (standing wave ratio) values. The antenna circuit board is preferably attached within the antenna box which is closed on all sides, to the inner side of the metallic upper side of the box with or without spacer elements, in order to ensure that the antenna feed-in points are as short as possible with respect to the external antenna elements. Furthermore there is provision that not only one antenna circuit board is arranged in the antenna box but rather that a plurality of circuit boards within the antenna box are connected, for example by means of plugs (for example ribbon cables with corresponding plugs), to the antenna circuit board.

The outer cover forms a type of protective hood for the antenna elements located therein. This outer cover can be a separate part which is clipped onto the upper side of the antenna box. In order to mount the antenna module, the antenna module is mounted from the inner side of the vehicle on the vehicle roof in such a way that the antenna elements project through the opening in the roof and therefore achieve their effect outside the vehicle insofar as they are provided for vehicle-external connections. The external part which can be seen with the outer cover and which projects out of the vehicle roof is similar in its shape to the fins which are customary today. The antenna box which is located within the vehicle can, on the other hand, be rectangular, round or have any desired other shape. In this context, the antenna box is positioned only between the vehicle roof and a roof lining.

Moreover, there is provision that the antenna module has in the region of the outer cover latching points which simplify mounting and securing in the opening in that the antenna module is pushed through the opening and latched onto the vehicle roof. However, before connection plug sockets for the different digital and analog services are connected to the antenna module within the vehicle, the antenna box which is closed on all sides can additionally be screwed to the vehicle roof from the inner side in order, inter alia, to absorb the mechanical forces which occur and which impact on the connection plug sockets and to transmit them to the vehicle body. Moreover, a horizontal slot or horizontal groove can be provided on the upper side of the antenna box, in order to secure the antenna module to the vehicle roof by means of a translatory movement in the direction of travel or in the direction opposite to the direction of travel.

In a further embodiment of the invention, it is provided that the antenna module has exclusively a single external antenna for the services RKE (remote keyless entry), PASE (passive start entry) and TPMS (tire pressure monitoring system). Furthermore, it is, however, also possible to provide exclusively internal antennas for the abovementioned service as well as to make available a combination of internal and external antennas which are implemented in such a way that the external part of the antenna is in the region of the outer cover, that is to say under a protective hood, like the outer hood, and the internal part of the antenna is provided in the antenna box, which, however, is appropriate only if a lower part of the antenna box which is closed on all sides is composed of plastic.

In a further embodiment of the invention, for this purpose the antenna box itself has an upper part and a lower part, wherein the upper part contains the metallic upper side and edge sides and partially overlaps with edge sides of the lower part, wherein the lower part can be constructed with its edge sides made of plastic. The connection between the lower part and the upper part can be provided in a mechanically detachable fashion on the edge sides by means of snap-action hooks and snap-action clips. On the other hand, it is also possible to connect the outer cover to the upper side of the antenna box using such snap-action hooks and snap-action clips.

In a further embodiment of the invention there is provision that the at least one antenna circuit board has electronic printed circuits on its upper side, wherein the antenna circuit board is secured to the upper part of the antenna box by means of the spacer elements mentioned above, and wherein the printed circuits of the upper side of the circuit board are electrically connected by means of vias through the antenna circuit board to the amplifier elements, the transceivers, the tuners or receivers on the lower side of the antenna circuit board which is oriented toward the passenger compartment of the vehicle.

On the outer edges of the antenna box which is closed on all sides, plug-in connectors for CAN (controlled area network) BUS feed lines, LIN (local interconnect network) connections, MOST (media oriented system transport) connections, USB (universal serial bus) interfaces or ethernet accesses can be arranged, which plug-in connectors project out of these edge sides of the lower part of the antenna box and into the passenger compartment of the vehicle between the vehicle roof and the roof lining, and via which plug-in connectors at least a large part of the communication with terminals in the vehicle takes place.

Furthermore, the antenna module has, in a further embodiment of the invention, at least four radio services which occur in a vehicle, from a group comprising telephone, AM/FM (amplitude modulation system/frequency modulation system, DAB (digital audio broadcasting), SDARS (satellite digital audio radio system), GPS (global positioning system), WLAN (wireless area network), LTE (long term evolution), WIMAX (worldwide interoperability for microwave access), DRM (digital radio mondiale), UMTS (universal mobile telecommunication system), Bluetooth (digital wireless data exchange), RKE (remote keyless entry) RSS (remote starting system), PASE (passive start entry), VHS (vehicle heating system), C2C (car to car communication system), ACC (automatic cruise control), TPMS (tire pressure monitoring system), which can be covered centrally by the antenna module.

In addition there is provision that a telephone and RKE antenna (remote keyless entry) has a circuit board which projects into the fin-shaped outer cover and is perpendicular to the antenna box and has in its foot region a cutout in which, for example, a GPS antenna can be arranged as a patch antenna. In this context, the GPS patch antenna can be arranged on an external shielding chamber on the upper part of the antenna box, which shielding chamber itself encloses an amplifier circuit and/or an antenna adaptation circuit within the shielding chamber.

Moreover, there is provision that an SDARS antenna is arranged as a patch antenna at a distance from the GPS patch antenna on an external shielding chamber on the upper part of the antenna box, wherein the shielding chamber also encloses an amplifier circuit and/or an antenna adaptation circuit for the SDARS antenna.

In order to bring about a safe contact, running around the opening, with an electrically conductive vehicle roof, coupling elements made of metallic foamed material or electrically conductive foamed material can be provided on the upper side of the antenna box in the longitudinal direction, on both sides of the opening in the vehicle roof or around the opening in the vehicle roof. With such coupling elements, the upper side of the antenna box can be adapted to curvatures of the inside of a vehicle roof.

BRIEF DESCRIPTION OF THE DRAWINGS

The invention will now be explained in more detail with reference to the appended figures.

DETAILED DESCRIPTION OF THE PREFERRED EMBODIMENTS

Figure 1:
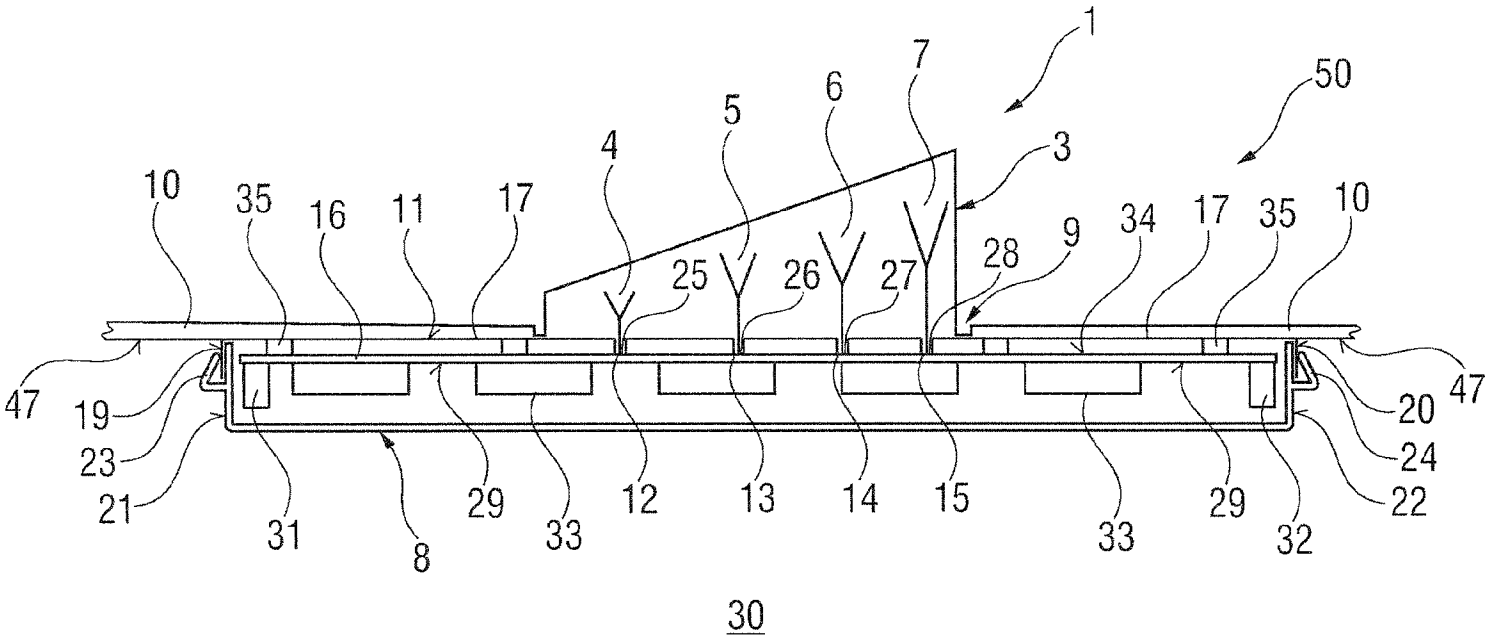
FIG. 1 shows a basic sketch of an antenna module according to a first embodiment of the invention.

FIG. 1 shows a basic sketch of an antenna module 1 according to a first embodiment of the invention. The antenna module 1 is intended for a motor vehicle 50 and is arranged on a vehicle roof 10. A fin-shaped outer cover 3 projects out of the vehicle roof 10, from an opening 9 in the vehicle roof 10. This outer cover 3 is at the same time a protective sheath for the antenna elements 4, 5, 6 and 7 arranged under the protective sheath. Feed-in points 25, 26, 27 and 28 of the antenna elements 4, 5, 6 and 7 are connected electrically to an antenna circuit board 16 via feedthroughs 12, 13, 14 and 15. The antenna circuit board 16 is accommodated in an antenna box which is closed on all sides, wherein the antenna box 8 is connected in an electrically conductive fashion to an inner side 47 of the vehicle roof 10.

For this purpose, the antenna box 8 has an electrically conductive upper part 17 which is electrically connected to the inner side 47 of the vehicle roof 10. This electrically conductive upper part 17 has edge sides 19 and 20 which are equipped with snap-action hooks 23 which engage with snap-action clips 24 on edge sides 21 and 22 of a plastic lower part 18 of the antenna box 8 which is closed on all sides. For this purpose, the edge sides 19 and 20 of the metallic upper part 17 overlap with the edge sides 21 and 22 of the plastic lower part 18. The upper part 17 has a metallic upper side 11 which is electrically connected in electrical contact with the electrically conductive vehicle roof 10 on the inner side 47 thereof, with the result that an electromagnetic isolation is ensured between the antenna elements 4, 5, 6 and 7 projecting out from the roof 10 and the passenger compartment of the vehicle.

While the upper side 34 of the antenna circuit 16 has feed-in points 25, 26, 27 and 28 for the antenna elements 4, 5, 6 and 7 as well as adaptation circuits in the form of printed circuits, a plurality of shielding plates 33, which enclose the transceivers, receivers and/or tuners, are arranged on the underside 29, which is oriented toward a passenger compartment 30 of the vehicle. The shielding plates 33 protect the transceivers, receivers and/or tuners against electromagnetic radiation which can be output by internal antennas 31 and 32 on the lower side 29 of the antenna circuit board 16, and against electromagnetic coupling of inductive or capacitive coupling of the different electronic circuits between one another.

The transceivers, receivers or tuners under the shielding plates 33 are connected by means of vias through the antenna circuit board 16 to the upper side 34 of the circuit board 16 and therefore to adaptation circuits and to the feed-in points 25, 26, 27 and 28 of the antenna elements 4, 5, 6 and 7. Spacer elements 35 are arranged between the metallic electrically conductive upper side 11 of the antenna box 8 and the upper side 34 of the antenna circuit board 16, said spacer elements 35 ensuring that the adaptation circuits which are arranged on the upper side 34 of the antenna circuit board 16 are not short-circuited or damaged by the metallic upper side of the antenna box 8. The spacer elements are dimensioned to be as small as possible in order to keep a coaxial coupling length via the feedthroughs 12, 13, 14 and 15 between the antenna elements 4, 5, 6 and 7 and the feed-in points 25, 26, 27 and 28 of the antenna circuit board 16 as small as possible and to minimize transmission losses at the feedthroughs 12, 13, 14 and 15.

In order to permit wireless, vehicle-internal connections, such as Bluetooth, the antenna elements 31 and 32 in the edge regions of the antenna circuit board 16 are provided on the lower side 29 of the antenna circuit board 16. Furthermore, for this reason in this embodiment of the invention the lower part 18 which is secured by snap-action clips 24 to the edge-side snap-action hooks 23 of the upper part 17, is manufactured from plastic.

Figure 2:
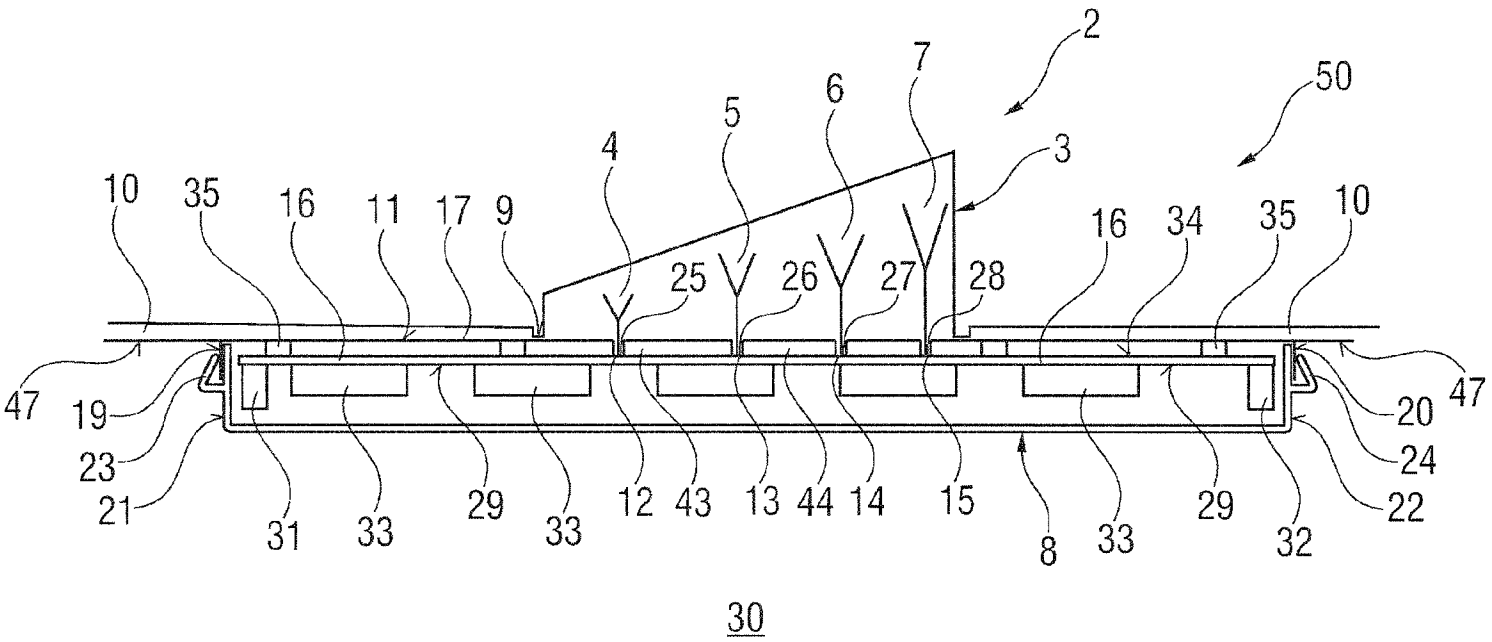
FIG. 2 shows a basic sketch of an antenna module according to a second embodiment of the invention.

FIG. 2 shows a basic sketch of an antenna module 2 according to a second embodiment of the invention. Components with the same functions as in FIG. 1 are characterized by the same reference symbols and are not mentioned specially.

The difference between the second embodiment of the invention compared to the first embodiment of the invention which is shown in FIG. 1 is that shielding plates 33 are provided not only on the lower side 29 of the antenna circuit board 16 but shielding chambers 43 and 44 are additionally arranged on the upper side 34, said shielding chambers 43 and 44 having circuits which interact with the feed-in points 25, 26, 27 or 28 of the antenna elements 4, 5, 6 or 7.

Figure 3:
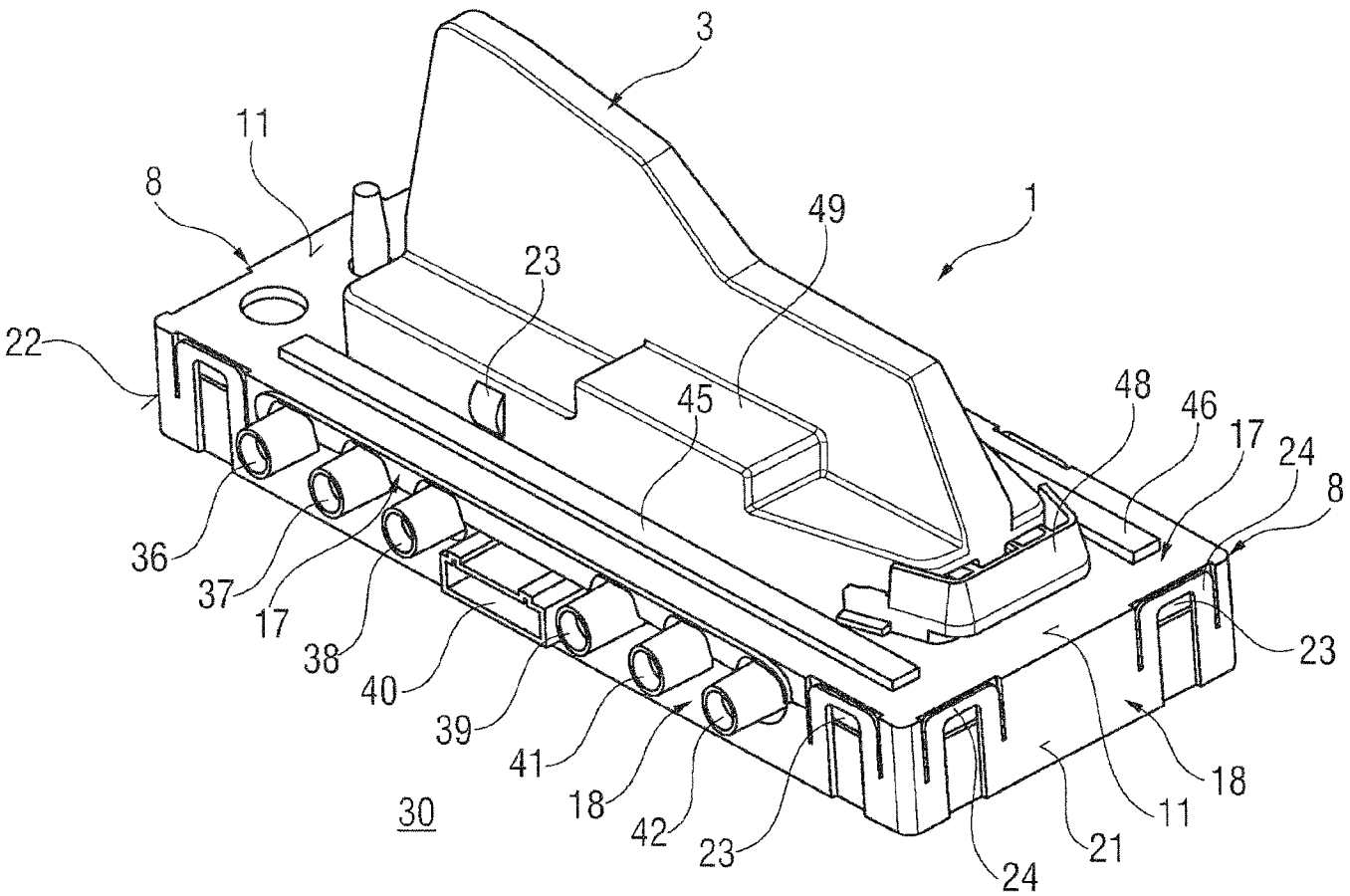
FIG. 3 shows a schematic perspective view of one of the antenna modules according to one of the preceding embodiments of the invention.

FIG. 3 shows a schematic perspective view of one of the antenna modules 1 according to one of the preceding embodiments of the invention, wherein the antenna module 1 is plugged together in one piece from three areas. An upper area has the already mentioned outer cover 3, with which the antenna module 1 which is shown in FIG. 3 can project beyond a vehicle roof. This cover 3 is connected via snap-action hooks 23 to the metallic upper side 11 of an upper part 17 of an antenna box 8 which is closed on all sides, wherein the antenna box 8 is arranged completely between a vehicle roof and a vehicle roof cover in the passenger compartment 30 of the vehicle.

In addition to the snap-action hooks 23 of the outer cover 3, which engage with the metallic upper side 11 of the upper part 17, a securing element 48 is also provided with which the antenna module 1 can be detachably secured in an opening of a vehicle roof. In addition, the metallically conductive upper side 11 of the upper part 17 of the antenna box 8 has coupling elements 45, 46 on both sides of the outer cover 3, with which coupling elements 45 and 46 an electrical connection to a lower side of a vehicle roof is made possible, wherein these coupling elements 45 and 46 can be manufactured from electrically conductive foamed material in order to compensate for curvatures of the vehicle roof with respect to the upper side of the antenna box 8 and bring about good electrical contact between the metallic upper side 11 of the antenna box 8 and a lower side of a vehicle roof.

Plug-in connectors 36 to 42 project out of the edge regions of the antenna box 8, to which plug-in connectors 36 to 42 it is possible to connect the coaxial lines which can be connected between the roof lining and the vehicle roof via the plug-in connectors 36 to 42 to the antenna box 8 which is closed on all sides, and electrical connections to the different reception, display or control devices in the vehicle can be made available. In this context, in particular the plug-in connector 40 is provided for digital interfaces.

Figure 4:
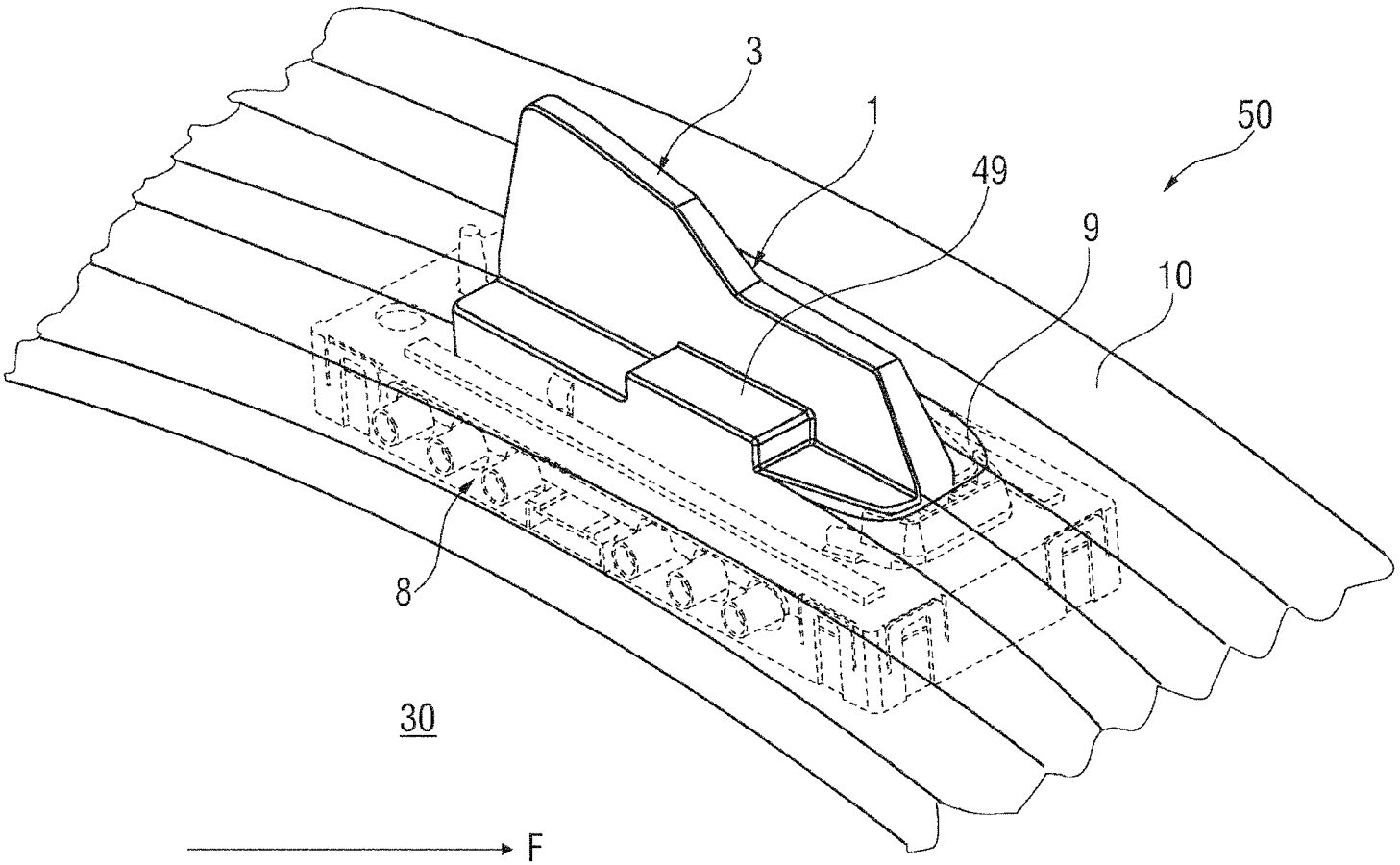
FIG. 4 shows a schematic perspective view of the antenna module according to FIG. 3 after installation in a motor vehicle.

FIG. 4 shows a schematic perspective view of the antenna module 1 according to FIG. 3 after installation in a motor vehicle 50. For this purpose, an opening 9, through which the outer cover 3 of the antenna module 1 projects, is provided in the vehicle roof 10, with the result that the antenna elements arranged under the outer cover 3 which is composed of a plastic material are positioned above the vehicle roof 10. While some of the antenna elements are oriented vertically with respect to the vehicle roof 10, with the result that a fin-shaped outer cover 3 is produced, flat, virtually square antenna elements, such as, for example, patch antennas for GPS or SDARS connections, can be arranged in an area 49 of the outer cover 3 which is arranged horizontally with respect to said outer cover 3.

The antenna box 8 which is closed on all sides is characterized in FIG. 4 by dashed lines in order to illustrate that it is arranged with its electrically conductive metallic upper side between the lower side of the vehicle roof 10 and a roof lining. The direction of travel of the vehicle 50 is indicated here by an arrow F in order to show that the outer cover 3 projects like part of a tail fin or a fish's fin from the vehicle roof 10.

Although at least exemplary embodiments have been shown in the preceding description, various changes and modifications can be performed. The specified embodiments are merely examples and are not provided for limiting the scope of validity, the applicability or the configuration in any way. Instead, the description above provides a person skilled in the art with a plan for implementing at least exemplary embodiments, wherein numerous changes can be made to the function and arrangement of the elements described in the exemplary embodiments without departing from the scope of protection of the appended claims and their legal equivalents.

LIST OF REFERENCE SYMBOLS

1 Antenna module ($1^{st}$ embodiment)
2 Antenna module ($2^{nd}$ embodiment)
3 Outer cover
4 Antenna element
5 Antenna element
6 Antenna element
7 Antenna element
8 Antenna box
9 Opening
10 Vehicle roof
11 Upper side
12 Feedthrough
13 Feedthrough
14 Feedthrough
15 Feedthrough
16 Antenna circuit board
17 Upper part
18 Lower part
19 Edge side
20 Edge side
21 Edge side
22 Edge side
23 Snap-action hook
24 Snap-action clip

25 Feed-in point
26 Feed-in point
27 Feed-in point
28 Feed-in point
29 Lower side
30 Passenger compartment of the vehicle
31 Antenna element
32 Antenna element
33 Shielding plates
34 Upper side
35 Spacer element
36 Plug-in connector
37 Plug-in connector
38 Plug-in connector
39 Plug-in connector
40 Plug-in connector
41 Plug-in connector
42 Plug-in connector
43 Shielding chamber
44 Shielding chamber
45 Coupling element
46 Coupling element
47 Inner side
48 Securing element
49 Area
50 Vehicle
F Direction of travel

The invention claimed is:

1. An antenna module which is one piece and has a plurality of external receiving and/or transmitting antenna elements under an outer cover, and comprises an antenna box, which has no or few internal antennas on the inner side and encloses electronic circuits which interact with the antenna elements, wherein the outer cover is detachably secured to the antenna box, and wherein the outer cover can be attached through an opening in a vehicle roof in such a way that it projects out of the vehicle roof, and wherein the antenna box is closed on all sides and includes a metallic upper side which can be attached underneath the vehicle roof, and wherein the metallic upper side of the antenna box has a plurality of separate feedthroughs to the external antenna elements, wherein each of the external antenna elements in the outer cover extends through a respective one of the plurality of feedthroughs into the antenna box and are electrically and physically coupled to the circuits within the antenna box, and wherein the metallic upper side of the antenna box has coupling elements formed from metallic foamed material and adapted to electrically connect the metallic upper side of the antenna box to an inner side of the vehicle roof.

2. The antenna module as claimed in claim 1, wherein at least one antenna circuit board with the electronic circuits and with the few or no internal antennas is arranged in the antenna box, and wherein antenna elements are soldered to this antenna circuit board.

3. The antenna module as claimed in claim 2, wherein within the antenna box, at least one further antenna element for vehicle-internal communication is arranged on a lower side of the antenna circuit board which is oriented toward a passenger compartment of the vehicle.

4. The antenna module as claimed in claim 2, wherein amplifier circuits or antenna adaptation circuits, transceivers, receivers or tuners which are surrounded by shielding plates are arranged on a lower side of the antenna circuit board which is oriented toward a passenger compartment of the vehicle.

5. The antenna module as claimed in claim 4, wherein the at least one antenna circuit board has electronic printed circuits on its upper side, and wherein the antenna circuit board is secured to an upper part of the antenna box by spacer elements, and wherein the printed circuits of the upper side of the circuit board are electrically connected, by vias through the antenna circuit board, to amplifier elements, the transceivers, the tuners or receivers on the lower side of the antenna circuit board which is oriented toward the passenger compartment of the vehicle.

6. The antenna module as claimed in claim 2, wherein the antenna box has an upper part and a lower part, and wherein the upper part has the metallic upper side and edge sides which partially overlap with edge sides of the lower part.

7. The antenna module as claimed in claim 1, wherein the antenna box has an upper part and a lower part, and wherein the upper part has the metallic upper side and edge sides which partially overlap with edge sides of the lower part.

8. The antenna module as claimed in claim 7, wherein the feedthroughs in the metallic upper side of the upper part have coaxial feedthroughs to feed-in points of the antenna elements in the common outer cover.

9. The antenna module as claimed in claim 7, wherein a lower part of the antenna box has an electrically insulated plastic material.

10. The antenna module as claimed in claim 1, wherein the outer cover is embodied in a fin shape and is connected to the antenna box in a mechanically detachable fashion by snap-action hooks and snap-action clips.

11. The antenna module as claimed in claim 10, wherein the feedthroughs in the metallic upper side of the upper part have coaxial feedthroughs to feed-in points of the antenna elements in the common outer cover.

12. The antenna module as claimed in claim 1, wherein plug-in connectors for CAN (controlled area network) BUS feed lines, LIN (local interconnect network) connections, MOST (media oriented system transport) connections, USB (universal serial bus) interfaces or ethernet accesses project out of edge sides of the lower part of the antenna box and into a passenger compartment of the vehicle between the vehicle roof and roof lining, via which plug-in connectors at least a part of the communication with terminals in the vehicle takes place.

13. The antenna module as claimed in claim 1, wherein the antenna module covers centrally at least four radio services occurring in a vehicle selected from the group consisting of:

telephone,
AM/FM (amplitude modulation system/frequency modulation system),
DAB (digital audio broadcasting player),
SDARS (satellite digital audio radio system),
GPS (global positioning system),
WLAN (wireless area network),
LTE 2×MIMO (long term evolution two times multiple input multiple output),
WIMAX (worldwide interoperability for microwave access),
DRM (digital radio mondiale),
UMTS (universal mobile telecommunication system),
Bluetooth (digital wireless data exchange),
RKE (remote keyless entry),
RSS (remote starting system),
PASE (passive start entry),
VHS (vehicle heating system),
C2C (car to car communication system),
ACC (automatic cruise control) and
TPMS (tire pressure monitoring system).

14. The antenna module as claimed in claim 13, wherein a telephone and RKE antenna has a plate which projects into the fin-shaped outer cover and is perpendicular to the antenna box and has in its foot region a cutout in which a GPS antenna is arranged as a patch antenna.

15. The antenna module as claimed in claim 13, wherein a GPS patch antenna is arranged on an external shielding chamber on the upper part of the antenna box, which shielding chamber encloses an amplifier circuit and/or an antenna adaptation circuit.

16. The antenna module as claimed in claim 13, wherein an SDARS antenna is arranged as a patch antenna at a distance from the GPS patch antenna on one of the external shielding chambers on the upper part of the antenna box, wherein the shielding chamber encloses an amplifier circuit and/or an antenna adaptation circuit.

17. The antenna module as claimed in claim 1, wherein an antenna box size can be adapted to further services and/or further electronic circuits.

18. The antenna module as claimed in claim 1, wherein the antenna box comprises metal and/or plastic.

19. An antenna module which is one piece and has at least one external receiving and/or transmitting antenna element under an outer cover, and comprises an antenna box, which has no or few internal antennas on the inner side and encloses electronic circuits which interact with the antenna elements, wherein the outer cover is detachably secured to the antenna box, and wherein the outer cover can be attached through an opening in a vehicle roof in such a way that it projects out of the vehicle roof, and wherein the antenna box is closed on all sides and includes a metallic upper side which can be attached underneath the vehicle roof, and wherein the metallic upper side of the antenna box has feedthroughs to the external antenna elements, wherein the external antenna elements in the outer cover extend through the feedthroughs into the antenna box and are electrically and physically coupled to the circuits within the antenna box, and wherein the metallic upper side of the antenna box has coupling elements formed from metallic foamed material and adapted to electrically connect the metallic upper side of the antenna box to an inner side of the vehicle roof in order to electromagnetically isolate the antenna elements from an interior of the vehicle.

* * * * *